US006435379B2

(12) United States Patent
Tansley et al.

(10) Patent No.: US 6,435,379 B2
(45) Date of Patent: Aug. 20, 2002

(54) BOTTLED LIQUID DISPENSERS

(75) Inventors: Robert Tansley, Stratford upon Avon; Hugh Connell, Evesham, both of (GB)

(73) Assignee: Ebac Limited, Durham (GB)

( * ) Notice: Subject to any disclaimer, the term of this patent is extended or adjusted under 35 U.S.C. 154(b) by 0 days.

(21) Appl. No.: 09/732,749

(22) Filed: Dec. 11, 2000

(30) Foreign Application Priority Data

Dec. 16, 1999 (GB) ..... 9929742
Mar. 13, 2000 (GB) ..... 0005836

(51) Int. Cl.[7] ..... B67D 5/00

(52) U.S. Cl. ..... 222/464.2; 222/400.7; 222/400.8; 222/396; 141/67

(58) Field of Search ..... 222/396, 399, 222/400.7, 400.8, 464.2; 141/67

(56) References Cited

U.S. PATENT DOCUMENTS 3,486,661 A * 12/1969 Friedrich et al. ..... 222/464.2
3,825,154 A * 7/1974 Jaeger ..... 222/400.8
3,880,330 A * 4/1975 Leas et al. ..... 222/400.7
3,933,282 A * 1/1976 Stevens, Jr. ..... 222/400.7
4,159,790 A * 7/1979 Bailey ..... 222/464.2
4,676,404 A * 6/1987 Yamazaki et al. ..... 222/399
5,303,845 A * 4/1994 Osawa ..... 222/399
5,377,875 A * 1/1995 Kock et al. ..... 222/464.2
5,492,249 A * 2/1996 Beach ..... 222/399
5,511,692 A * 4/1996 Willingham ..... 222/400.7
5,915,595 A * 6/1999 Dow et al. ..... 222/464.2
6,085,997 A * 7/2000 Mills et al. ..... 222/399

* cited by examiner

*Primary Examiner*—J. Casimer Jacyna
(74) *Attorney, Agent, or Firm*—Miles & Stockbridge P.C.; John C. Kerins

(57) ABSTRACT

Liquid is supplied from a bottle B to a discharge outlet 8 via a molded plastics reservoir 15 by pressurizing the bottle using an air pump 22. A pressure sensor responds to a rise in air pressure supplied to the bottle by shutting off the pump. Liquid is removed from the reservoir through a dip tube 17 having a main outlet 18 adjacent to the bottom of the reservoir and a smaller auxiliary outlet 21 adjacent to the top of the reservoir. The upper region of the reservoir is received in a finned heat-conducting holder 16 provided with a thermoelectric cooling element. For hygienic purposes the bottle has a connector 12 which can be replaced together with the reservoir 15 and associated supply tubes 24, 13, 14, 17 and 19. A temperature-control mixer 51 may be to mix liquid from the reservoir with liquid from the bottle.

8 Claims, 7 Drawing Sheets

BOTTLED LIQUID DISPENSERS

TECHNICAL FIELD OF THE INVENTION

This invention relates to bottled liquid dispensers.

BACKGROUND

Large floor-standing bottled water dispensers are well known in offices and other commercial premises. For example, EP 0 581 491 A describes a water dispenser having a vertically elongate housing which supports an inverted bottle. A feed tube projects upwardly into the neck of the bottle through which liquid discharges under gravity into a reservoir in the form of a flexible bag. For hygienic purposes the feed tube is incorporated in unit which can be removed together with the bag and relaced during a maintenance operation.

The present invention seeks to provide a new and inventive form of bottled liquid dispenser which is smaller and more compact than known dispensers of the kind described in the aforementioned patent.

SUMMARY OF THE INVENTION

The present invention provides a bottled liquid dispenser in which liquid is supplied from a bottle to a discharge outlet via a reservoir, wherein the reservoir contains a draw tube for removing liquid from the reservoir to supply said discharge outlet, said draw tube having a main outlet port adjacent to the bottom of the reservoir and an auxiliary outlet port adjacent to the top of the reservoir.

The auxiliary port allows air to purge from the reservoir without having to use a bleed valve or similar means. Furthermore, when the bottle becomes empty and air starts to enter the reservoir, air is discharged as soon as the auxiliary port is uncovered. The reservoir therefore remains filled with liquid so that delivery recommences almost immediately after the bottle is changed.

The invention also proposes a bottled liquid dispenser in which liquid is supplied from a bottle to a discharge outlet via a reservoir, including an air pump means arranged to supply pressurised air to the bottle to cause movement of liquid from the bottle to said reservoir, and a pressure sensor responsive to the pressure of air supplied to the bottle to limit the rise in air pressure produced by said air pump means.

With such an arrangement the height of the dispenser is minimised since the dispenser can operate with little or no pressure head. The arrangement also has the following advantages:

A high instantaneous discharge rate can be achieved compared with a liquid pump.

An air filter can be included in the air supply to the bottle.

If the bottle contains carbonated soft drinks, pressurisation of the bottle reduces the risk of the contents becoming flat as the bottle becomes empty.

Low cost.

The pressure sensor is preferably arranged to switch off the air pump means when the sensed air pressure exceeds a predetermined level.

The invention also proposes a bottled liquid dispenser in which liquid is supplied from a bottle to a discharge outlet via a reservoir, wherein the dispenser includes means for holding the bottle, a bottle connector for releasable sealing engagement with a neck formed at the top of the bottle, the bottle connector being provided with an air inlet for supplying air to an upper region of the bottle, a dip tube for removing liquid from a lower region of the bottle, and a transfer tube for supplying liquid to the reservoir, thermal means for controlling the temperature of liquid in the reservoir, and an outlet tube for conducting liquid from the reservoir to a discharge outlet, wherein the reservoir is removably received within the thermal means such that, for hygiene purposes, the reservoir and the bottle connector can be removed together with associated tubes and replaced with clean components.

To maintain hygiene the replaceable components can be changed at intervals.

The air inlet is preferably connected to a releasable coupling which incorporates an air filter whereby the air filter is replaced with the bottle connector and reservoir. The air tube preferably supplies air under pressure to the bottle.

The bottle connector preferably incorporates a rotatable connection, which prevents kinking of the tubes.

The invention also provides a bottled liquid dispenser in which liquid is supplied from a bottle to a discharge outlet via a reservoir, wherein the reservoir is pre-formed for removable reception in a heat-conducting holder which embraces an upper region of the reservoir and said holder includes thermoelectric means for controlling the temperature of liquid in the reservoir.

The portion of the reservoir below the holder is preferably stepped inwardly.

The reservoir is preferably moulded of a semi-rigid plastics material.

The thermal means preferably includes a peltier element.

The holder is preferably provided with a plurality of heat-conducting fins, and the holder is preferably provided with means for creating an air flow over the fins.

The invention also provides a bottled liquid dispenser in which liquid is supplied from a bottle to a discharge outlet via a reservoir, and said dispenser includes thermal means for controlling the temperature of liquid in the reservoir, and mixer means for mixing liquid from the reservoir with liquid from the bottle to supply said discharge outlet.

BRIEF DESCRIPTION OF THE DRAWINGS

The following description and the accompanying drawings referred to therein are included by way of non-limiting example in order to illustrate how the invention may be put into practice. In the drawings.

DETAILED DESCRIPTION OF THE DRAWINGS

Figure 1:
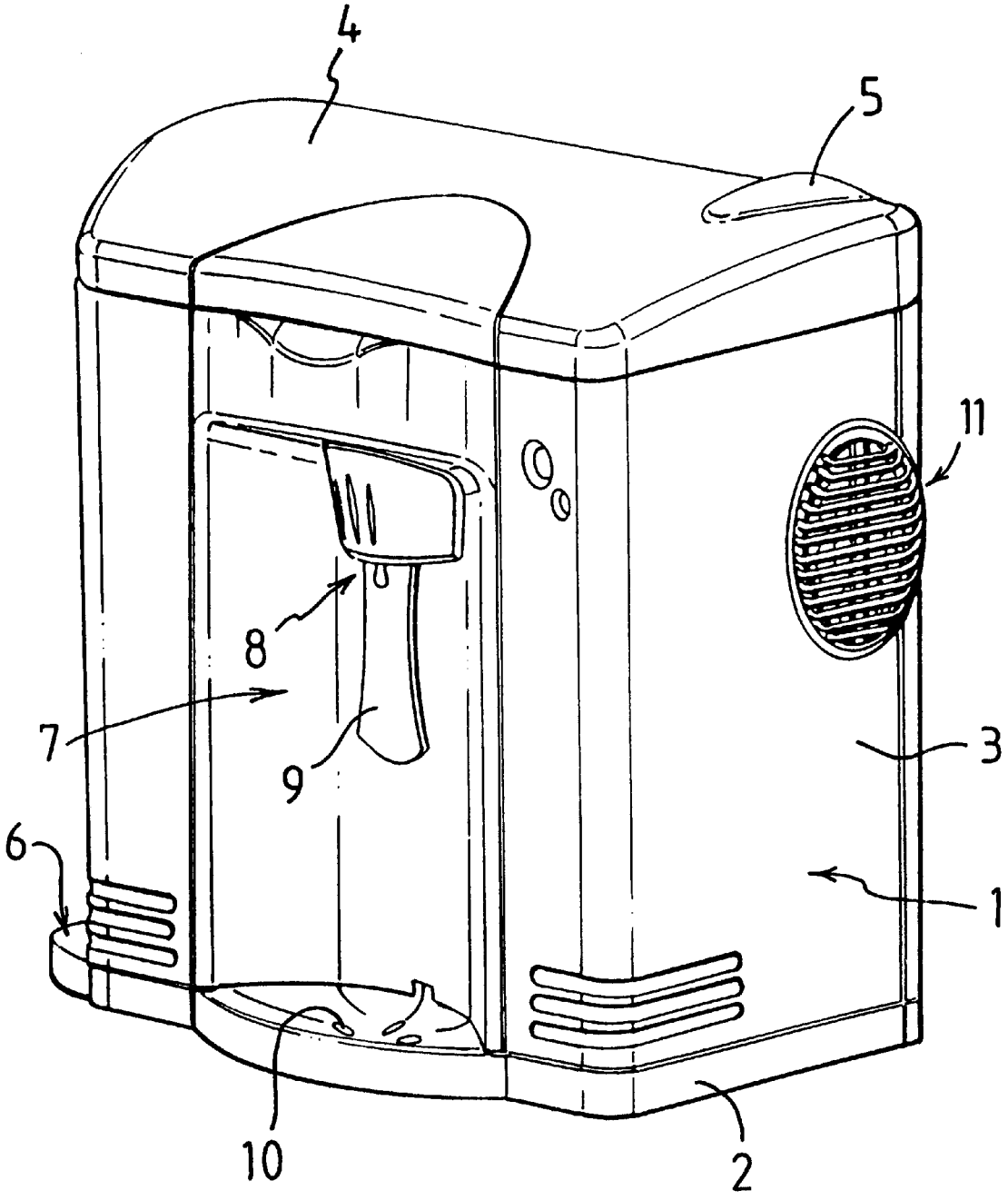
FIG. 1 is a general view showing the front, top and one side of a bottled water dispenser in accordance with the invention.

The bottled water dispenser shown in the drawings is suitable for use on a kitchen work surface or the like.

Figure 2:
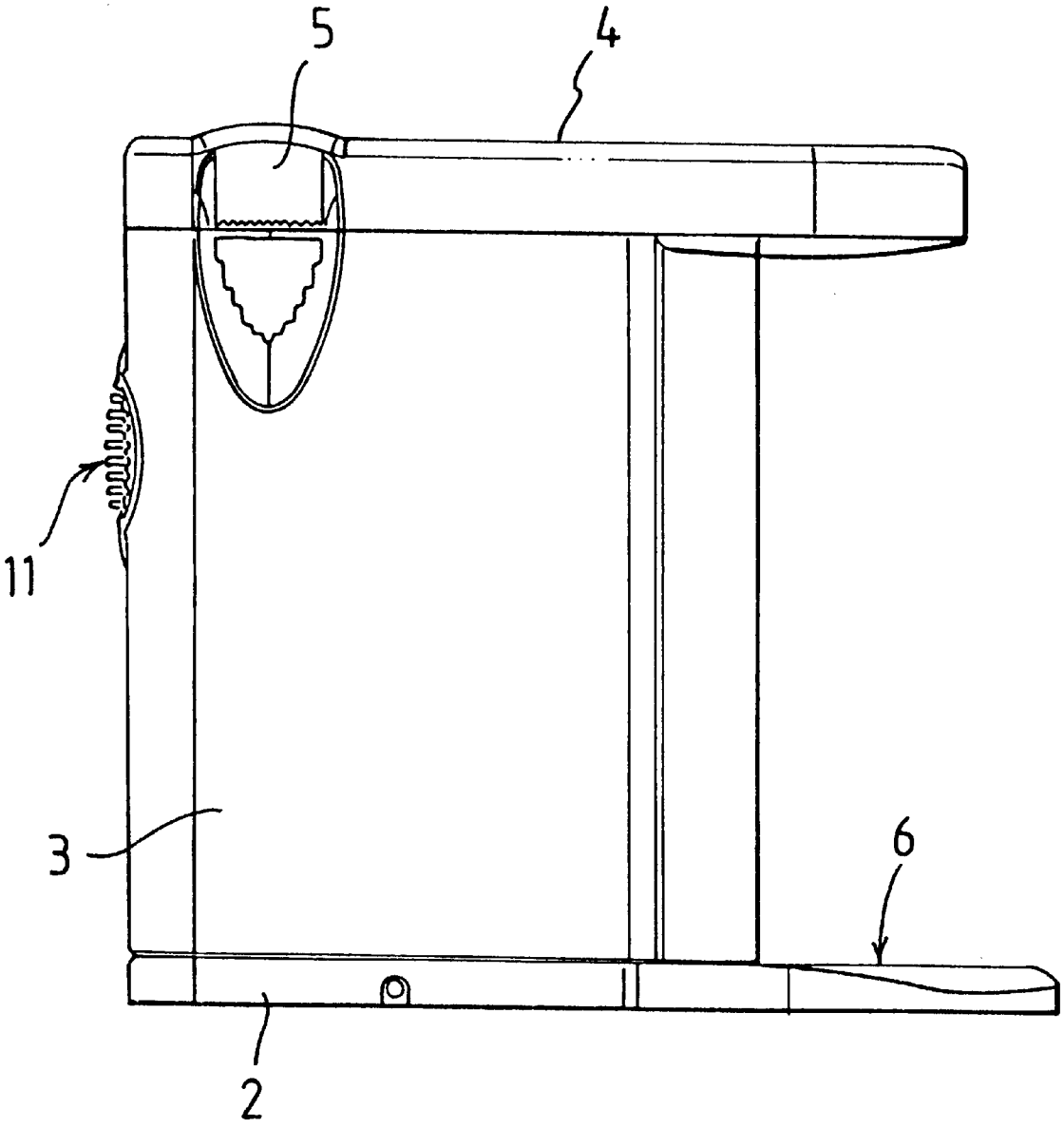
FIG. 2 is a rear elevation of the dispenser.

Referring to FIG. 1, the dispenser comprises a moulded plastics housing 1 having a base 2 and side walls 3. A lid 4 is connected to the side walls by a single hinge 5 at the rear of the housing. At one side of the housing the base 2 projects from the wall 3, best seen in FIG. 2, to form a platform 6 for supporting a water bottle (not shown), which may be a 5 liter capacity bottle of the kind which can be purchased from supermarkets and other retail outlets. The lid 4 projects over the platform 6 to cover the neck of the bottle.

At the front of the housing the wall 3 is formed with a recess 7 for receiving a drinking vessel, which is normally held by hand during filling. A water outlet, indicated generally at 8, is located at the top of the recess for dispensing water into the drinking vessel under the control of a valve which is operated by a lever 9. The bottom of the recess is formed by the base 2, which may be slightly concave and may also be provided with drainage apertures 10 to collect any small spillages of water.

On the opposite side of the housing relative to the platform 6 there is an air vent 11.

Figure 3:
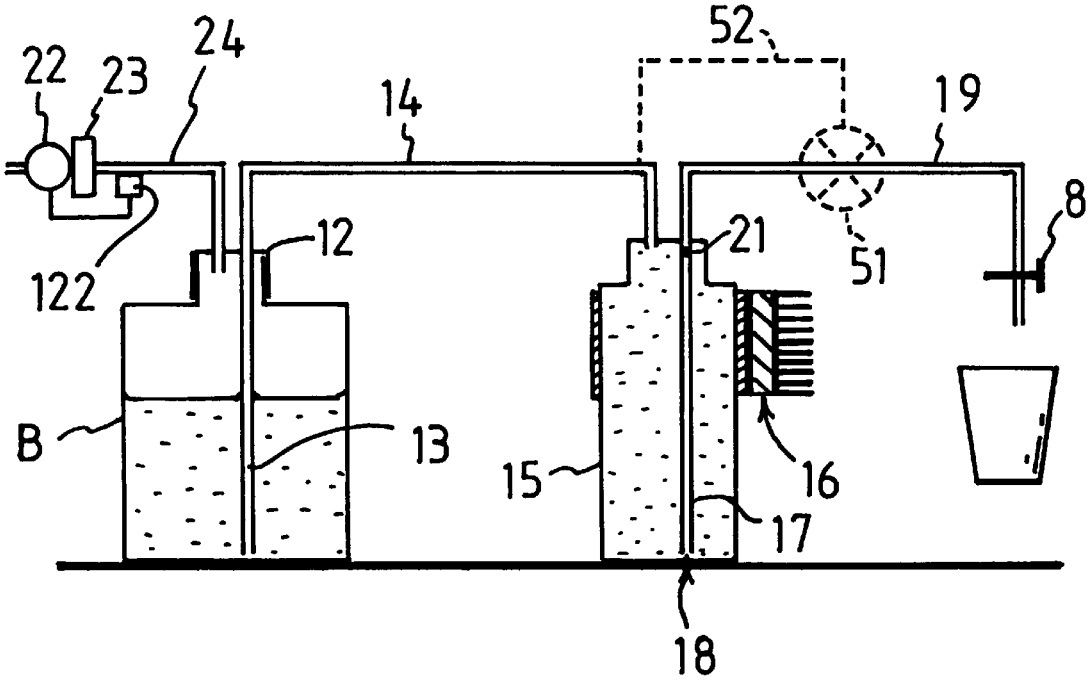
FIG. 3 is a schematic drawing showing the internal components of the dispenser.

The main internal components of the water cooler are shown diagrammatically in FIG. 3. A bottle connector 12 is coupled to the neck of the water bottle B. The connector 12 incorporates a flexible dip tube 13 which is connected to a transfer tube 14 leading to the upper part of a reservoir 15. The reservoir is provided with an external cooling device 16 for cooling liquid in the reservoir. A draw tube 17, having a main outlet opening 18 at the bottom of the reservoir, extends through the top of the reservoir 15. The draw tube is connected to an outlet tube 19 for transferring cooled liquid to the discharge valve 8. It will be noted that the draw tube 17 has an auxiliary outlet opening 21 at the top of the reservoir, of smaller diameter than the main opening 18.

The bottle B and reservoir 15 are located alongside each other at substantially the same level. An air pump 22 supplies atmospheric air via an air filter 23 and air tube 24, through the connector 12 into the top of the bottle B. This pressurises the bottle so that when the discharge valve 8 is opened water flows from the bottle B into the reservoir 15 displacing cooled water from the reservoir through the openings 18 and 21.

The pump 22 is provided with a pressure sensitive switch 122 which shuts off the pump when the pressure at the pump outlet rises above a predetermined level. The cutoff pressure is set to ensure that there is sufficient pressure in the system to dispense a useable quantity of liquid when the valve 8 is opened. Normally the pump will start as soon as the pressure drops, thereby ensuring a continuous discharge of cooled water at an acceptable rate.

The dispenser is also useful for cooling fizzy soft drinks since the carbonation is maintained by the pressurisation of the bottle.

The auxiliary outlet port 21 allows air to purge from the reservoir 15 as the reservoir fills with liquid for the first time. Furthermore, when all the water has been removed from the bottle B and air therefore starts to enter the reservoir, air will start to discharge from the reservoir as soon as the port 21 is uncovered. The reservoir therefore remains filled with water so that when the bottle is replaced with a full bottle, delivery recommences almost immediately.

Figure 4:
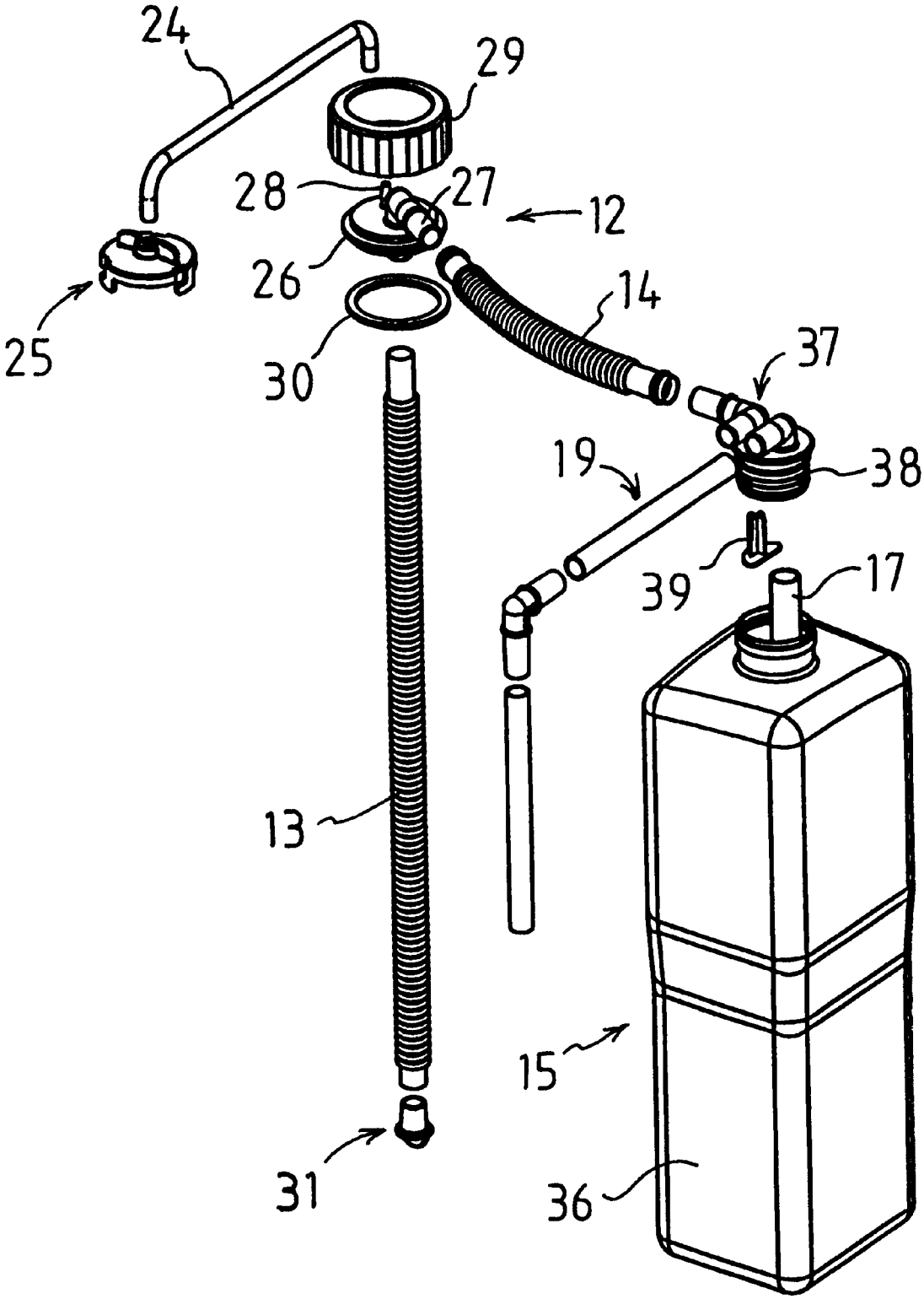
FIG. 4 is a more detailed general view of the replaceable components of the dispenser.

Bottled water should be supplied free from bacteria and impurities. In order to maintain a high level of hygiene all of the components which come into contact with the water can be periodically replaced with a new set of clean components. FIG. 4 shows the replaceable parts of the dispenser in more detail. Components which correspond to those of FIG. 3 are referenced similarly. The air filter 23 is housed within a twist-lock connector 25 for releasable connection with the air pump 22. The bottle connector 12 incorporates a moulded cap 26 to which the tubes 24, 13 and 14 are coupled. The cap has an angled through-connector 27 to which the dip tube 13 and transfer tube 14 are coupled while the air tube 24 is pushed onto a tubular spigot 28. The cap 26 is held onto the neck of the bottle by a screwthreaded flanged ring 29, with a sealing ring 30 interposed between the cap and the rim of the bottle. The ring 29 thus allows the cap 26 to be connected with the bottle without twisting the tubes which are connected to the cap. The cap 26 and/or the ring 29 can be changed, if required, for use with different kinds of bottle.

Figure 5:
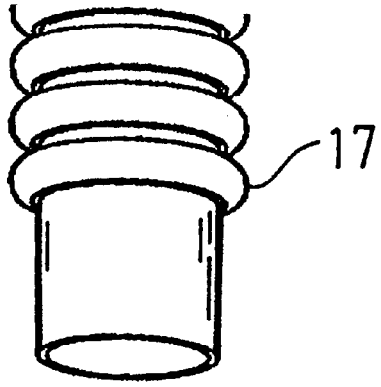
FIG. 5 is a general view of a single component of the dispenser, namely a tip moulding.
Figure 5:
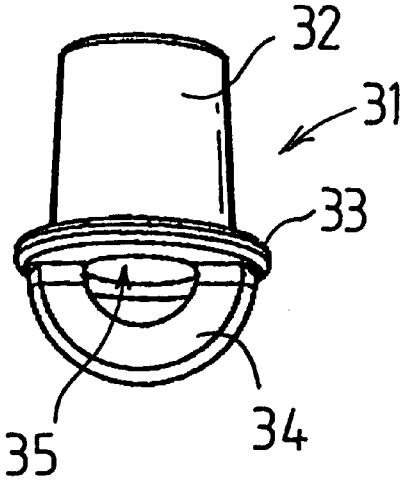

The dip tube 13 and the transfer tube 14 are formed of corrugated-wall plastic to allow them to be easily stretched and flexed during bottle replacement without being longer than necessary. The volume of water which they hold is thus kept to a minimum. A tip moulding 31, also shown in FIG. 5, prevents the dip tube 13 from being obstructed by contact with the bottle B. The moulding has a generally cylindrical portion 32 which is a press-fit into the end of the dip tube 13 and is provided with an external flange 33. The flange carries an arcuate projection 34 which prevents the entry hole 35 from being obstructed.

Figure 6:
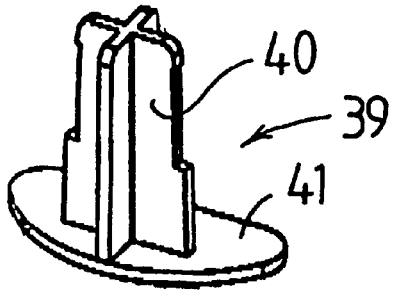
FIG. 6 is a general view of another component of the dispenser, namely a flow spreader.

Referring back to FIG. 4, the reservoir 15 is moulded of polythene or a similar semi-rigid thermoplastic and is vertically elongate, being of square or rectangular cross section. The bottom portion 36 of the reservoir is stepped inwardly for ease of insertion into the cooling device 16. The tubes 14, 17 and 19 are connected to the reservoir via coupling spigots 37 formed on a screw-threaded plug 38. A flow spreader 39, shown also in FIG. 6 is inserted into the water inlet spigot of the plug 38. The spreader has a cruciform section 40 which is inserted into the spigot and which carries an external end plate 41. Thus, when water enters the reservoir through the plug 38 it hits the plate 41 and is dispersed into the top region of the reservoir to reduce mixing of the warmer water entering the reservoir with the cooled water at the bottom of the reservoir.

Figure 7:
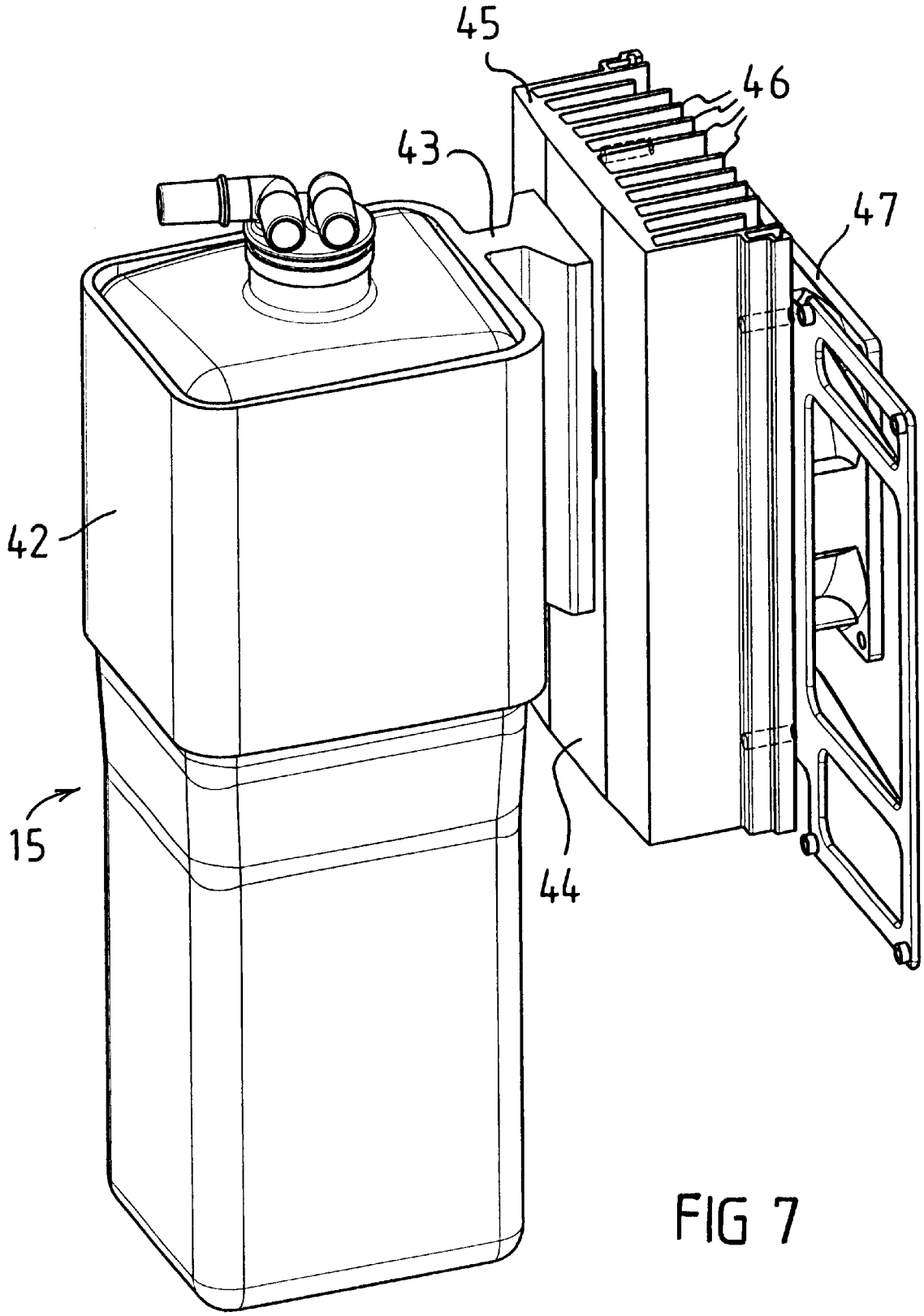
FIG. 7 is a general view of the reservoir and cooling unit of the dispenser.

Referring to FIG. 7, the cooling device includes a heat-conducting metal sleeve 42 which snugly receives the upper part of the reservoir 15, being shaped such that there is a minimal air gap between the reservoir and the sleeve. The sleeve 42 is formed with an integral vertically extending T-section head 43, which is coupled to the cold side of a thermostatically controlled peltier cooling unit 44. The opposite hot side of the peltier unit is thermally coupled with a heatsink plate 45 having an array of closely spaced parallel vertical cooling fins 46 projecting away from the reservoir. A fan 47 is mounted on the fins adjacent to the air vent 11 to force air between them. Thus, the peltier unit 44 removes heat from the water in the reservoir, which is dissipated into the atmosphere. Since warmer water will tend to move to the top of the reservoir by convention currents, cooling of the reservoir is very efficient.

Figure 8:
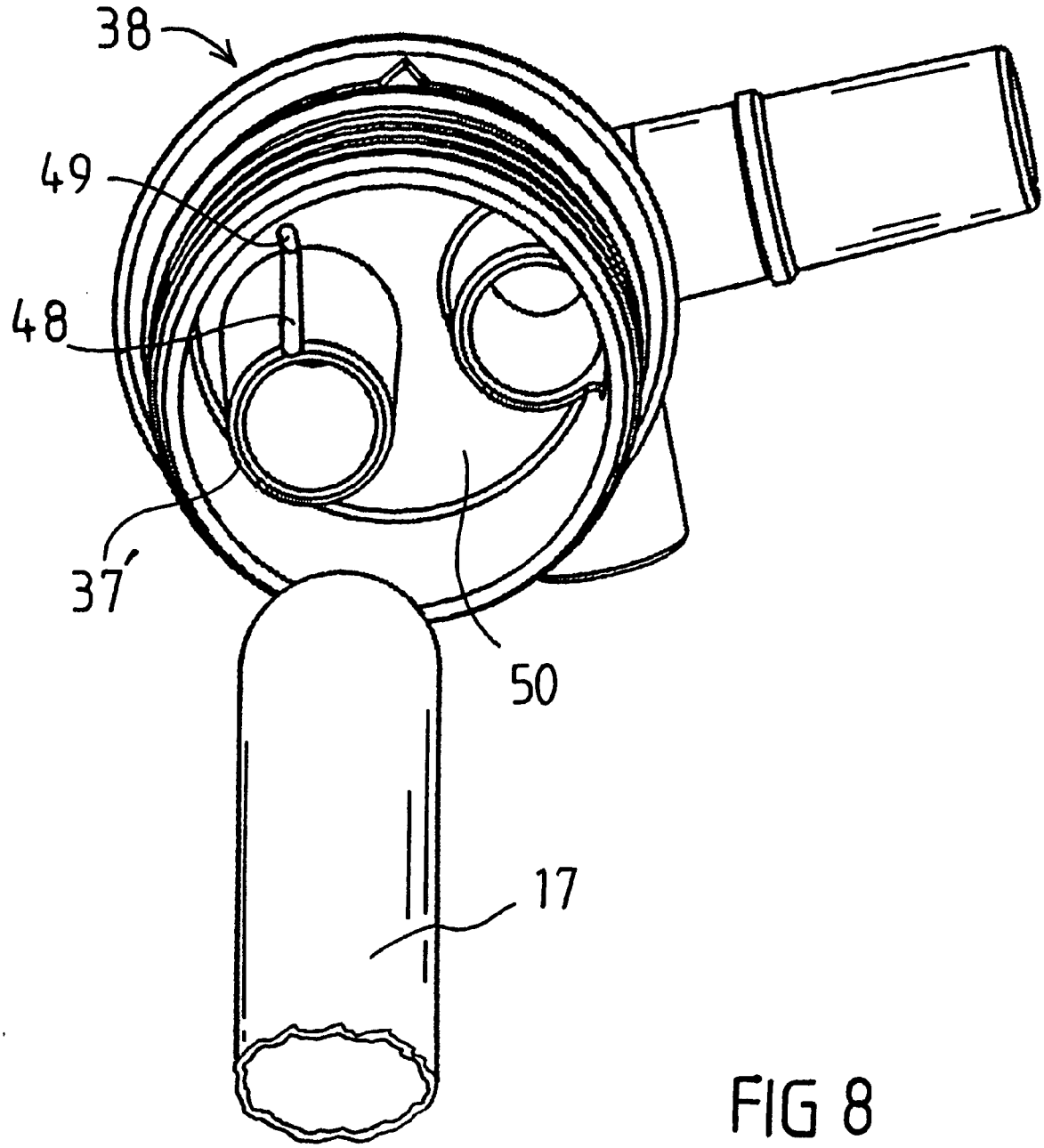
FIG. 8 is a bottom view of another component, namely the plug of FIG. 4.

Although FIG. 3 shows the auxiliary outlet port 21 as a hole in the draw tube 17 it is preferably formed in the plug moulding 38. As can be seen in FIG. 8, the outlet port may comprise an axial groove 48 which extends along the external surface of the spigot 37' on which the draw tube 17 is received. The groove also extends for a short distance 49 along the top wall 50 of the plug, beyond the wall of the draw tube, so that air and water can pass from the highest part of the reservoir into the draw tube 17 via the groove sections 49 and 48. This arrangement ensures complete purging of air from the reservoir.

In a modification to the basic cooler shown in FIG. 3, the temperature of the dispensed water can be instantly controlled by means of a mixer valve 51. The mixer valve is connected in the tube 19 and receives water at ambient temperature through a bypass tube 52 from the bottle B through transfer tube 14. Thus, the user can vary the relative proportions of cooled and ambient water issuing from the discharge valve 8.

It will be appreciated that the features disclosed herein may be present in any feasible combination. Whilst the above description lays emphasis on those areas which, in combination, are believed to be new, protection is claimed for any inventive combination of the features disclosed herein.

We claim:

1. A bottled liquid dispenser which includes a bottle connector for releasable sealing engagement with a bottle of liquid, a reservoir arranged to receive a supply of liquid from the bottle through said bottle connector, and a discharge outlet for dispensing liquid from the reservoir, wherein the reservoir contains a draw tube for removing liquid from the reservoir to supply said discharge outlet, said draw tube having a main outlet port adjacent to the bottom of the reservoir and an auxiliary outlet port adjacent to the top of the reservoir.

2. A bottled liquid dispenser according to claim 1, in which said auxiliary outlet port is smaller than said main outlet port.

3. A bottled liquid dispenser as recited in claim 1, further including an air pump means arranged to supply pressurised air to the bottle to cause movement of liquid from the bottle to said reservoir, and a pressure sensor responsive to the pressure of air supplied to the bottle to limit the rise in air pressure produced by said air pump means.

4. A bottled liquid dispenser according to claim 3, in which the pressure sensor is arranged to switch off the air pump means when the sensed air pressure exceeds a predetermined level.

5. A bottled liquid dispenser as recited in claim 1, further including means for controlling the temperature of liquid in the reservoir.

6. A bottled liquid dispenser as recited in claim 5, wherein the temperature controlling means comprises a cooling device.

7. A bottled liquid dispenser as recited in claim 6, wherein the cooling device is a thermostatically controlled Peltier cooling unit.

8. A bottled liquid dispenser as recited in claim 1, in which the reservoir is moulded of a semi-rigid plastics material.

* * * * *